United States Patent [19]

Allen

[11] 3,976,133

[45] Aug. 24, 1976

[54] RETRIEVABLE WELL PACKER

[75] Inventor: Richard Glenn Allen, Houston, Tex.

[73] Assignee: Brown Oil Tools, Inc., Houston, Tex.

[22] Filed: Feb. 5, 1975

[21] Appl. No.: 547,225

[52] U.S. Cl. ..... 166/120; 166/134; 166/182

[51] Int. Cl.[2] ..... E21B 33/12; E21B 23/00

[58] Field of Search ..... 166/120, 134, 135, 131, 166/184, 187, 212, 217, 182

[56] References Cited

UNITED STATES PATENTS

| | | | |
|---|---|---|---|
| 3,244,233 | 4/1966 | Villalon | 166/134 X |
| 3,285,343 | 11/1966 | Urbanosky | 166/217 X |
| 3,371,716 | 3/1968 | Current | 166/134 X |
| 3,391,740 | 7/1968 | Edwards | 166/120 |
| 3,398,795 | 8/1968 | Elliston | 166/120 |
| 3,659,647 | 5/1972 | Brown | 166/120 |

*Primary Examiner*—James A. Leppink
*Attorney, Agent, or Firm*—Torres & Berryhill

[57] ABSTRACT

Disclosed is a well packer which is set by pressure applied through a tubing string which supports the packer within a surrounding well conduit. Once set, the packer is retrievable by either longitudinal or rotary movement of the supporting tubing string. Setting pressure drives opposed cone assemblies longitudinally toward each other to cause slip segments to move radially outwardly into anchoring engagement with the surrounding well conduit. The lowermost cone assembly is constructed in the form of a split ring and is equipped with friction teeth along its internal surface to retain the packer in its set position. A helical retrieving component secures the packer assembly to the central mandrel of the packer. Righthand rotation of the tubing string causes the outer body of the packer to unthread from the helical retrieving component secured to the mandrel which in turn unsets the packer. Alternatively, the helical retrieving means can be sheared by applying a straight vertical pull to the tubing string permitting the packer to be unset.

10 Claims, 13 Drawing Figures

RETRIEVABLE WELL PACKER

BACKGROUND OF THE INVENTION

The present invention relates generally to the completion of oil and gas wells. More specifically, the present invention relates to a retrievable well packer assembly adapted to form a seal between a production tubing string and a surrounding well casing at a subsurface location within an oil or gas well.

U.S. Pat. No. 3,391,740 describes a retrievable well packer which is set by the fluid pressure applied through the tubing string from the well surface. In the patented assembly, the application of pressure causes an annular resilient seal assembly to expand radially into sealing engagement with the surrounding well casing, and thereafter, to radially expand metal anchoring dogs or "slips" into a secure frictional engagement with the well casing to prevent longitudinal displacement of the well packer. The assembly includes upper and lower spreading cones which are moved toward each other during the setting procedure to force the slip elements radially outwardly. Tapered locking segments, having friction teeth formed along their radially inner surfaces, are wedged behind the lower spreader cone assembly to hold the packer in its set position after the setting pressure is released. Retrieval of the packer is effected by pulling upwardly on the tubing string causing a shear pin to sever so that the spreader cones may be separated to permit the seal assembly and slip assembly to retract away from the surrounding casing.

SUMMARY OF THE INVENTION

The lower spreader assembly of the packer includes a split tapered cone segment which is provided with friction gripping teeth along its internal central surface. The radially outer surface of the cone segment is tapered and engages correspondingly tapered surfaces on the slip segments. Longitudinal movement of the cone segments toward each other forces the slip segments radially outwardly. The friction teeth on the lower cone bite into an underlying support sleeve forming a portion of the outer packer body to prevent reverse movement of the spreading cone segments so that the packer is held in its anchored position even after the setting pressure has been reduced. An annular piston ring which is employed to convert the setting pressure to longitudinal movement of the cone segments is connected to the lower cone segment by a lost motion means which permits the cone segments to move radially inwardly into gripping engagement with the underlying sleeve support. The described assembly eliminates the need for a separate locking segment and permits a simple, pressure driven piston ring to be employed for setting the packer.

From the foregoing, it will be appreciated that one of the important objects of the present invention is to provide a single piece element which functions both to expand the slip segments and to lock the packer in its set position.

It is also an important object of the present invention to provide a simplified piston ring which is responsive to the setting pressure for moving the locking cone segments as required to expand the slips into anchoring engagement with a surrounding well conduit. A related object is to provide an assembly in which the piston ring and cone spreader segments are connected by means which accommodate relative movement between the two components whereby the locking cone segments may be moved radially into locking engagement with the underlying sleeve support assembly without binding the longitudinally movable seal ring.

Other features, objects and advantages of the invention will become more readily apparent from the accompanying drawings, specification and claims.

DESCRIPTION OF THE ILLUSTRATED EMBODIMENT

Figure 1:
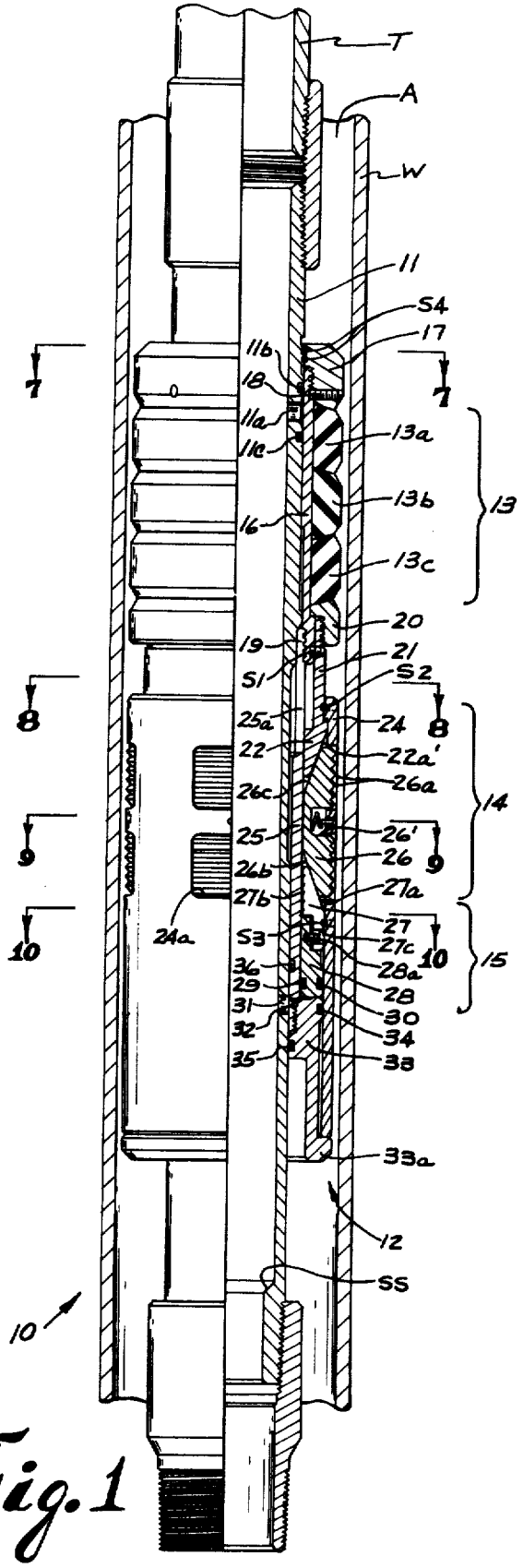
FIG. 1 is a view partially in elevation and partially in section, illustrating a quarter sectional view of the well packer of the present invention in its unset position as the packer is being run into the well.

The well packer of the present invention is illustrated generally at 10 in FIG. 1. The packer assembly is supported in a well casing W by a tubular production tubing string T which extends to the well surface (not illustrated). The well packer assembly includes a central, tubular mandrel 11 which supports an outer packer assembly indicated generally at 12. The outer assembly 12 includes a seal section 13, an anchoring section 14 and a setting section 15. The seal portion 13 includes a plurality of annular, resilient seal rings **13*a*, 13*b* and 13*c* carried on a seal sleeve member 16. An annular retaining ring 17 is threadedly secured to the upper end of the seal sleeve 16 and locked in place on the sleeve by a set screw 18. The lower end of the sleeve 16 is provided with an enlarged annular base 19 which forms a shoulder limiting the downward movement of a lower retaining ring 20. As will be described hereafter in greater detail, during the setting operation, the lower retaining ring 20 is moved upwardly over the seal sleeve 16 toward the ring 17 to radially expand the seal rings 13***a* through 13*c*.

At port 11*a*, illustrated in FIG. 1 being covered by the seal mounting sleeve 16 and sealed between upper and lower annular O-ring seals 11*b* and 11*a*, respectively, is opened during the retrieving operation to permit fluids in the annular area A to unload into the tubing string.

An upper spreader cone assembly which includes a tubular body 21 and a tapered conical head section 22 is threadedly secured to the lower retaining ring 20. The tubular body of the upper cone assembly is secured to the sleeve base 19 by a shear pin S1. While the shear pin S1 is intact, it prevents relative movement between the cone assembly, including the lower seal retaining ring 20, and the seal mounting sleeve 16.

Figure 8:
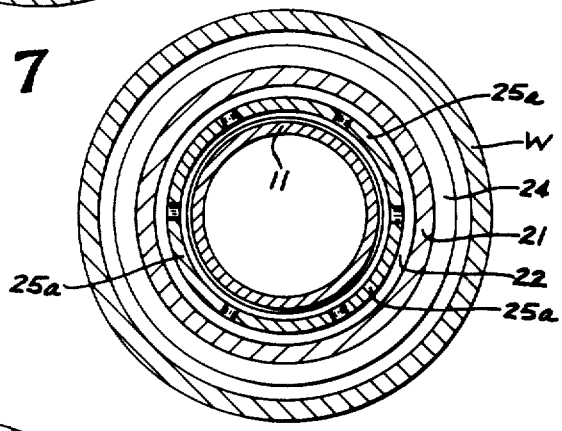
FIG. 8 is a horizontal cross-sectional view taken along line 8—8 of FIG. 1.

The conical head 22 of the upper spreader assembly is trapped between an outer tubular slip cage 24 and an underlying tubular slip mounting sleeve 25. A shoulder 22*a* (FIG. 3) on the spreader 22 engages an internal shoulder 24*a* (FIG. 3) on the slip cage 24 to hold the cone in place between the slip cage and the underlying slip mounting sleeve 25. The upper end of the slip mounting sleeve 25 is equipped with a plurality of collet fingers 25*a* which, at their upper end, include a plurality of annular grooves 25*b* (FIG. 5) which mate with a plurality of annular ridges 19*a* (FIG. 5) formed internally of the seal ring base 19. By joint reference to FIGS. 1 and 8, it may be noted that six collet fingers 25*a* are provided at the upper end of the slip mounting sleeve 25.

Figure 9:
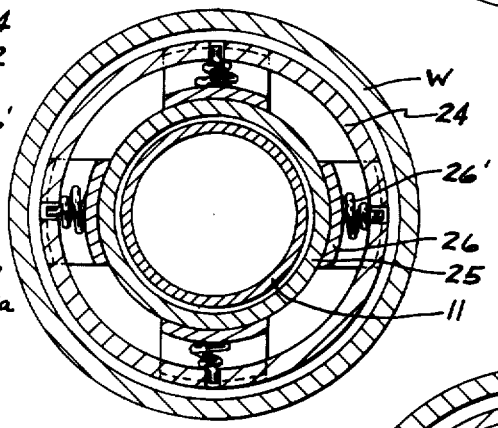
FIG. 9 is a horizontal cross-sectional view taken along line 9—9 of FIG. 1.

Four slip segments 26 are positioned between the slip mounting sleeve 25 and the surrounding slip cage 24. The relative position of the slip segments 26 may best be seen by joint reference to FIGS. 1 and 9. Windows 24*a* are provided in the slip cage 24 to expose teeth 26*a* formed on the radially outer surfaces of the slip segments 26. As will hereinafter be more fully explained, the slip segments 26 are expanded radially outwardly by the setting assembly 15 to force the friction teeth 26*a* into anchoring engagement with the internal wall of the surrounding well casing W.

Figure 10:
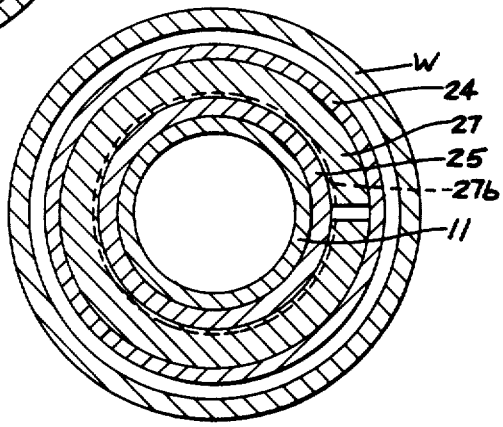
FIG. 10 is a horizontal cross-sectional view taken along line 10—10 of FIG. 1.

A lower locking cone 27 is disposed between the slip mount sleeve 25 and the lower end of the slip segments 26. As may be seen by reference to FIG. 10, the lower cone segment 27 is annular and is split so that it may move radially for a purpose hereinafter to be described. The spreading components 22 and 27 include radially outer, tapered bearing surfaces 22*a*′ and 27*a*, respectively, which engage and are adapted to slide against internal tapered bearing surfaces 26*c* and 26*b*, respectively, formed on the slip segments 26. As the components 22 and 27 advance toward each other, the wedging action caused by engagement of the tapered bearing surfaces causes the slip element 26 to move radially outwardly as required to anchor the well packer in place. Coil spring elements 26′ bias the slip segments 26 radially inwardly to their normally retracted position.

The longitudinal movement of the cone 27 required to set the packer is obtained from a pressure-driven piston ring 28 at the top of an expansion chamber EC. Resilient annular seal rings 29 and 30 form a sliding seal between the internal slip mount sleeve 25 and the slip cage 24. Fluid pressure supplied through the tubing string T and communicated to the piston 28 through radial ports 31 and 32 creates a pressure differential across the seal formed by the seal ring and seals 29 and 30 causing the seal ring to move upwardly through the annular area between the slip cage 24 and slip mounting sleeve 25. A lower retaining skirt 33, threadedly engaged to the lower end of the slip mounting sleeve 25, cooperates with annular O-ring type seals 34 and 35 to prevent pressure leakage. The lower end of the retaining apron 33 is provided with a shoulder 33*a* which holds the slip cage 24 in place. An annular O-ring seal 36 prevents loss of pressure between the mandrel 11 and the surrounding slip mounting sleeve 25.

The piston ring 28 is secured to the locking cone 27 by a set pin 28*a* which extends through an oversized bore 27*c* in the base of the lock cone. The tolerance between the set pin 28*a* and bore 27*c* accommodates relative radial movement between the piston ring 28 and the lock cone for a purpose to be described.

Setting of the well packer 10 requires the sequential severing of a series of connecting elements. These elements include the shear pin S1 connecting the base ring 19 to the upper spreader cone 21, a shear pin S2 connecting the upper end of the spreader cone 21 to the slip cage 24, and a shear pin S3 connecting the lock cone 27 to the slip cage 24. Release of the packer from its set position requires the shearing or threaded disengagement of a release means or retrieving element S4 which connects the upper seal ring 17 and sleeve 16 to the packer mandrel 11.

OPERATION OF THE WELL PACKER

Figure 2:
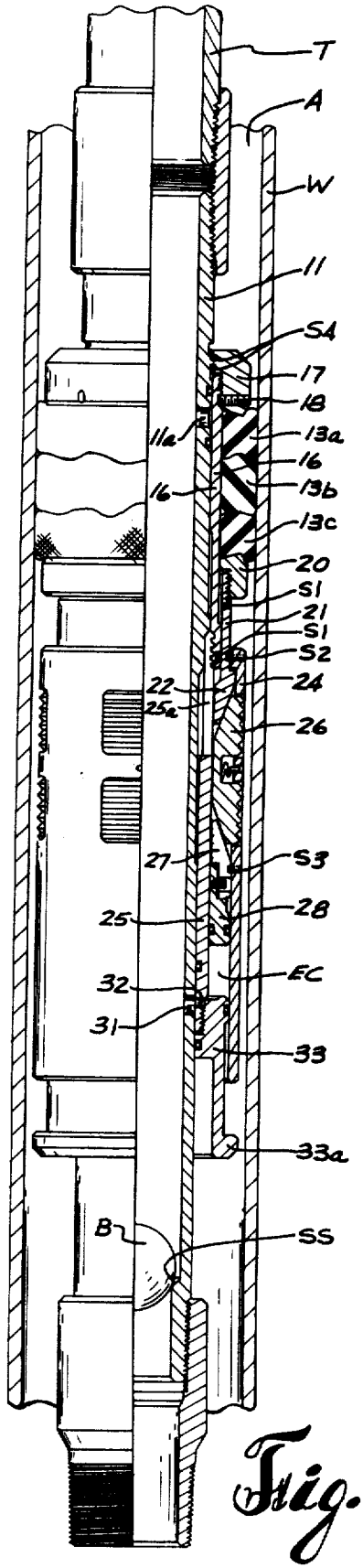
FIG. 2 is a view similar to FIG. 1 illustrating the seal assembly moved into sealing engagement with the surrounding well casing.
Figure 3:
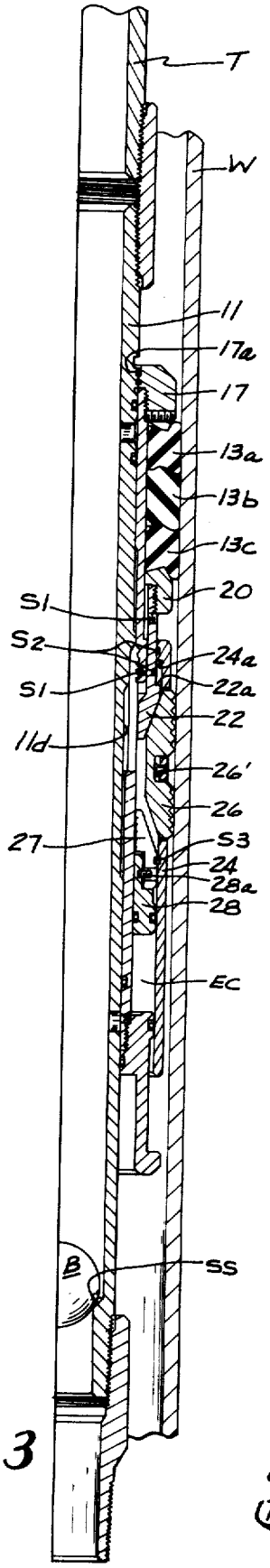
FIG. 3 is a longitudinal quarter sectional view of the well packer of FIGS. 1 and 2 illustrating the slip segments of the packer partially anchored against the surrounding well casing.

The well packer 10, with the components in the position illustrated in FIG. 1, is lowered to a desired subsurface location by the tubing string T. Thereafter, a ball B or other suitable plugging means is pumped into the tubing T and seated against a seat SS in a conventional manner. Once the ball B has seated, the continued application of fluid pressure acting through the ports 31 and 32 moves the piston ring 28 upwardly over the surface of the slip mounting sleeve 25. At this point, the shear pin S3 is still intact and the upward movement of the piston ring 28 acts through the locking cone 27 to push the slip cage 24 upwardly with the piston ring. The upward movement of the slip cage 24 is communicated through the shear pin S2 to the cone element 21 which in turn shears the pin S1 and forces the lower retaining ring 20 upwardly relative to the upper ring 17 to longitudinally compress the resilient seal members 13*a*–13*c*. The connection between the grooves 25*b* at the upper end of the slip mounting sleeve 25 and the teeth 19*a* at the lower end of the seal mounting sleeve 16 holds the upper retaining ring 17 stationary while the lower ring 20 is advanced toward it under the influence of the upwardly moving piston ring 28. This movement, illustrated in FIG. 2, causes the seal members to expand radially into sealing engagement with the internal wall of the surrounding casing W. Continued upward movement of the piston ring 28 and attached slip cage 24 ultimately severs the shear pin S2 as best illustrated in FIG. 3 of the drawings. Thereafter, the compressed force in the seal rings moves the spreading cone 22 downwardly and the continued upward movement of the piston ring 28 and attached slip cage 24 moves the slip elements 26 upwardly. The resulting relative movement between the spreader cone and slip element 26 overcomes the biasing force of the springs 26′ and forces the slip segments 26 radially outwardly into firm gripping engagement with the internal wall of the surrounding well casing W. At this point, it may be noted that the lower locking cone 27 has not yet engaged the slip segments 26.

Figure 4:
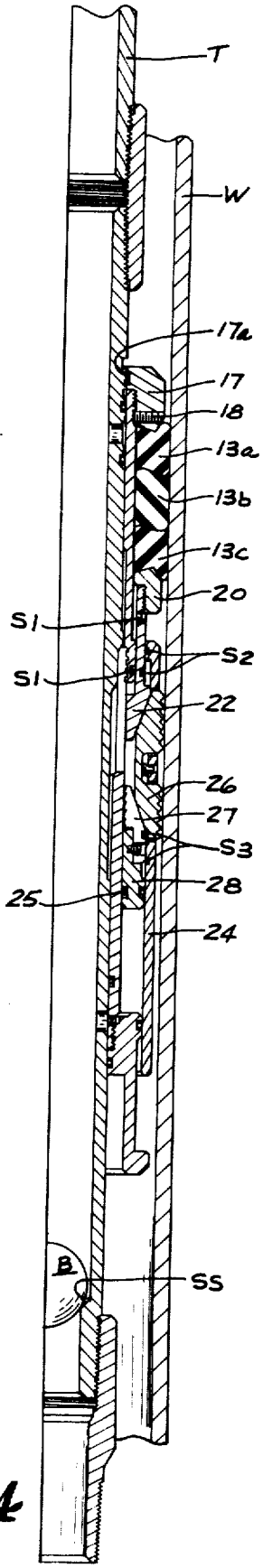
FIG. 4 is a view similar to FIG. 3 illustrating the well packer in its fully set position.

Once the slip segments 26 anchor against the surrounding casing wall, continued upward movement of the slip cage 24 is prevented and the subsequent movement of the pressure-driven piston ring 28 severs the shear pin S3 as illustrated in FIG. 4 of the drawings. When the pin S3 is severed, subsequent upward movement of the piston ring 28 serves to drive the locking cone 27 toward the upper cone 22 which in turn brings the tapered bearing surfaces of the locking cone against the bearing surfaces in the slips 26. The upward movement of the piston ring 28 continues until the frictional forces opposing the movement prevent further movement at the particular setting pressure being applied through the tubing string T.

During the described setting operation, the locking cone 27 is firmly wedged between the slip segments 26 and the underlying slip mounting sleeve 25. This wedging, locking engagement, caused in large part by the frictional engagement of the teeth 27*b*, prevents the well packer components from returning to their normally retracted positions even after the setting pressure has been terminated.

The use of dual cones in the configuration described permits the well packer to withstand pressure differentials acting from either above or below the packer seal since such differentials, irrespective of their direction, tend to increase the radially directed gripping forces exerted by the slip components 26 against the surrounding well conduit. Once the packer has been set, the ball B is circulated back to the surface whereby production through the tubing string T may be established.

RETRIEVING THE SET PACKER

In retrieving the packer from its anchored position, it is necessary to release the components of the assembly 12 so that the upper retaining ring 17 may move upwardly relative to the locking cone 27. This is accomplished by releasing the connection of the collet fingers 25*a* with the ring 19 at the lower end of the seal mounting sleeve 16. To effect such release, the tubing string T is either rotated clockwise (as observed in FIGS. 7–10, assuming the use of conventional righthand threads) to unthread the connection between the retrieving element S4 and the retaining ring 17, or, in the alternative, an upward vertical force is exerted on the tubing string T to simply shear the element S4 permitting the mandrel 11 to be moved upwardly relative to the outer packer assembly 12.

Figure 5:
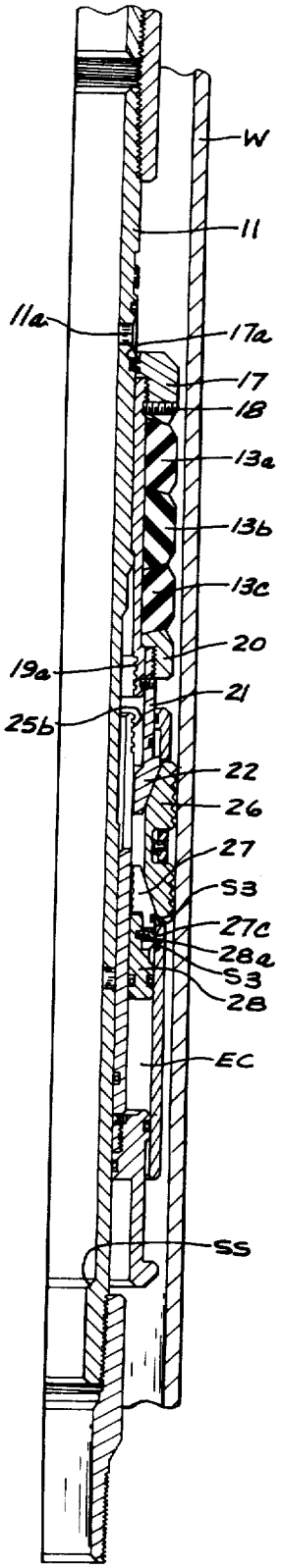
FIG. 5 is a view similar to FIGS. 3 and 4 illustrating the well packer of the present invention during the first portion of the retrieval operation with the seal assembly being returned to its innermost radial position out of engagement with the surrounding well casing.

The upward movement permitted by shearing the element S4, or unthreading it from its connection with the ring 17, permits the mandrel to be raised sufficiently so that a recessed annular area 11*d* is brought into registry with the connection between the collet fingers 25*a* and the base portion 19 of the seal ring 16. The engaging surfaces between the grooves 25*b* in the collet fingers and the ridges 19*a* in the base 19 are tapered and the axial forces acting on the two components force the resilient fingers 25*b* radially inwardly permitting the sleeves 16 and 25 to separate as illustrated in FIG. 5. Release of the mandrel 11 from the outer packer assembly 12 also opens the mandrel port 11*a* so that well fluids may drain into the tubing string T as the packer is being retrieved to avoid a swabbing effect.

Figure 6:
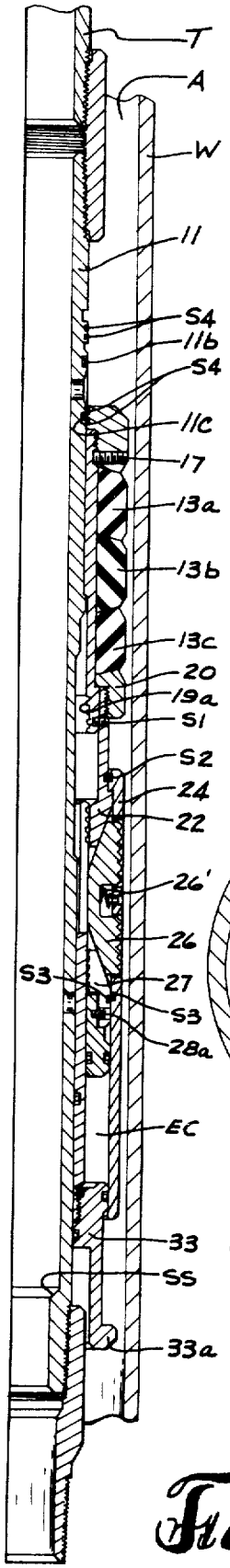
FIG. 6 is a view similar to FIGS. 3–5 illustrating the well packer assembly in its fully released position as it is being retrieved to the well surface.
Figure 7:
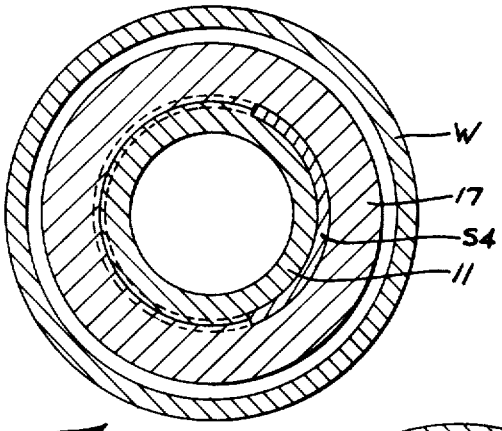
FIG. 7 is a horizontal cross-sectional view taken along line 7—7 of FIG. 1.

Once the seal sleeve 16 and slip sleeve 25 have separated, the force of the compressed seals 13*a*—13*c* returns the lower retaining ring 20 to its lowermost position which permits the seals to return to their radially inner position. The tubing string T is then raised upwardly drawing the shoulders 22*a* and 24*a* together, as illustrated in FIG. 6, which lifts the cage 24 upwardly relative to the lock cone 27. The resulting longitudinal separation between the upper cone 22 and the lower lock cone 27 permits the spring 26′ to return the slip segments 26 to its normally retracted position. The packer may then be retrieved to the well surface.

Figure 11:
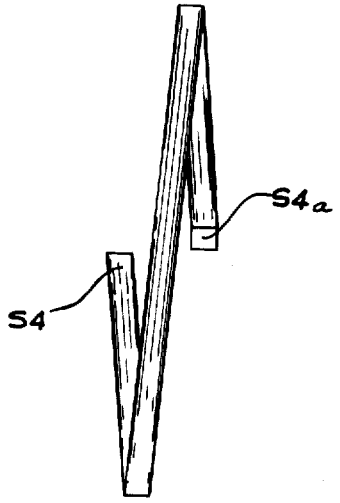
FIG. 11 is an elevation of a frangible retrieving element employed in the well packer of the present assembly.
Figure 12:
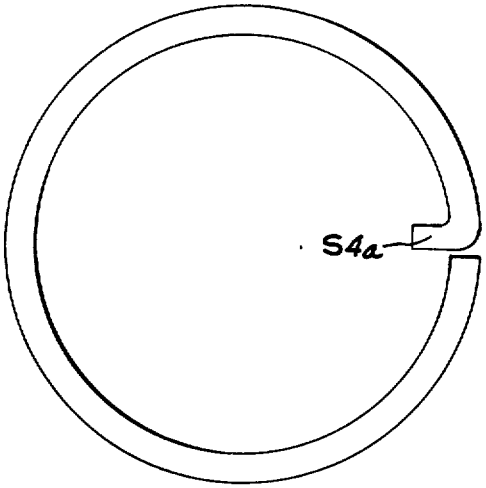
FIG. 12 is aa side view of the retrieving element of FIG. 11.
Figure 13:
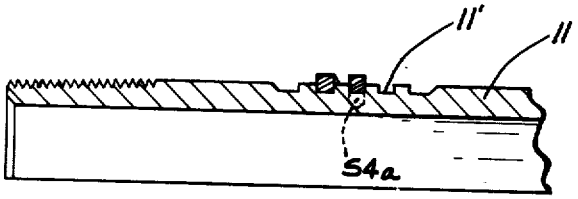
FIG. 13 is an enlarged partial cross-sectional view illustrating the positioning of the retrieving element on the mandrel of the well packer of the present invention.

FIGS. 11 through 13 describe details in the construction and placement of the retrieving component S4. The element 54 is of substantially helical configuration and is adapted to be received in helical slots 11′ formed on the external surface of the mandrel 11. One end of the element S4 is directed inwardly to provide a radial projection S4a which seats in a suitable recess formed in the mandrel 11 to prevent rotation of the element S4 relative to the mandrel. When thus positioned on the mandrel 11, the element S4 projects radially beyond the outer surface of the mandrel to provide coengaging releasing means which mate with a corresponding helical groove 17*a* (FIG. 5) formed in the upper seal retaining ring 17.

The element S4 is constructed of any material which can withstand shearing until the element is subjected to a preset release force, whereupon it is severable to permit relative movement between the mandrel and the upper seal ring 17.

The foregoing disclosure and description of the invention is illustrative and explanatory thereof, and various changes in the size, shape and materials as well as in the details of the illustrated construction may be made within the scope of the appended claims without departing from the spirit of the invention. By way of example rather than limitation, the well packer 10 may be employed with only the anchoring assembly 14 where an anchoring device rather than an anchoring and sealing device is required. Alternatively, only the seal assembly 14 may be required where only sealing and not anchoring is desired. Also, while the preferred form of the release means S4 is a continuous helix it will be appreciated that one or more and preferably several, shear pins on the mandrel 11 may slide through the helical groove 17*a* formed in the internal surface of the ring 17. Where several of such pins are employed, the pins would be distributed on the mandrel 11 along a helical path which matches the groove 17*a*. Other modifications will also be apparent to those having ordinary skill in the art.

I claim:

1. A well device adapted to be releasably anchored internally of a well conduit comprising:

a. a mandrel;

b. anchoring means carried by said mandrel for securing said well device to the internal surface of said well conduit, said anchoring means including radially movable slip means, movable between a radially extended position for effecting anchoring engagement with said internal surface and a radially retracted position for permitting said well device to be moved longitudinally through said well conduit;

c. friction creating means on the radially outer surface of said slip means for securely gripping the internal surface of said well conduit;

d. setting means included in said well device and associated with said anchoring means for moving said slip means from said radially retracted position to said radially extended position;

e. first slip moving means included in said setting means, said first slip moving means being carried about a central mounting means and including a split annular body having a tapered, radially outer bearing surface in operative engagement with said slip means whereby longitudinal movement of said first slip moving means along said central mounting means moves said slip means radially; and f. friction creating locking means carried on the radially inner surfaces of said first slip moving means for preventing longitudinal movement of said slip moving means in only one direction relative to said central mounting means whereby said first slip means may be locked in said extended position.

2. A well device as defined in claim 1 further including an annular seal assembly expandable radially by said setting means for forming a fluidtight seal between said well device and said well conduit.

3. A well device as defined in claim 1 further including frangible release means temporarily preventing movement of said mandrel relative to said locking means, said frangible means being severable when forces in excess of a predetermined value tend to longitudinally displace said mandrel and said locking means for releasing said slip means from said radially extended position.

4. A well device as defined in claim 3 further including an annular seal assembly expandable radially by said setting means for forming a fluidtight seal between said well device and said well conduit.

5. A well device as defined in claim 1 wherein said setting means includes second slip moving means having a tapered radially outer bearing surface and carried about said central mounting means, said second slip moving means being movable along said central mounting means toward said frist slip moving means for moving said slip means radially.

6. A well device as defined in claim 5 wherein said setting means includes pressure responsive means for moving said slip means and seal means into said extended position.

7. A well device as defined in claim 6 wherein:

a. said mandrel comprises a central tubular body;

b. said central mounting means includes a tubular sleeve member concentrically mounted about said mandrel; and c. said pressure responsive means includes annular piston means movable longitudinally relative to said tubular sleeve member.

8. A well device as defined in claim 6 further including an annular seal assembly expandable radially by said setting means for forming a fluidtight seal between said well device and said well conduit.

9. A well device as defined in claim 6 wherein:

a. said pressure responsive means includes an annular piston ring responsive to the application of setting pressure to move said first slip moving means; and b. a lost motion connection means is provided between said piston ring and said first slip moving means for permitting said first slip moving means to move radially relative to said piston ring.

10. A well device as defined in claim 9 further including frangible release means temporarily preventing movement of said mandrel relative to said locking means, said frangible means being severable when forces in excess of a predetermined value tend to longitudinally displace said mandrel and said locking means for releasing said slip means from said radially extended position.

* * * * *